US009890961B1

(12) United States Patent
Sheldon

(10) Patent No.: US 9,890,961 B1
(45) Date of Patent: Feb. 13, 2018

(54) AC WINDOW SECURITY DEVICE

(71) Applicant: Ronald S. Sheldon, Tolland, CT (US)

(72) Inventor: Ronald S. Sheldon, Tolland, CT (US)

( * ) Notice: Subject to any disclaimer, the term of this patent is extended or adjusted under 35 U.S.C. 154(b) by 0 days.

(21) Appl. No.: 15/142,289

(22) Filed: Apr. 29, 2016

Related U.S. Application Data

(60) Provisional application No. 62/174,947, filed on Jun. 12, 2015.

(51) Int. Cl.

| | |
|---|---|
| ***A47F 5/00*** | (2006.01) |
| ***F24F 1/02*** | (2011.01) |
| ***F16M 13/02*** | (2006.01) |
| ***F24F 13/32*** | (2006.01) |

(52) U.S. Cl.
CPC ..... *F24F 1/027* (2013.01); *F16M 13/02* (2013.01); *F24F 13/32* (2013.01)

(58) Field of Classification Search
CPC .. F24F 1/027; F24F 13/32; F24F 13/18; F24F 2221/20; E04G 3/18
USPC ..... 248/208, 209, 236; 454/196, 204
See application file for complete search history.

(56) References Cited

U.S. PATENT DOCUMENTS 1,214,057 A * 1/1917 Moore ..... E06B 7/28 454/196
2,978,973 A * 4/1961 Sweedyk ..... F24F 1/04 248/208
4,445,459 A * 5/1984 Julie ..... A01K 1/0236 119/28.5
4,498,374 A * 2/1985 Gibson ..... F24F 13/32 454/204
4,510,852 A * 4/1985 Sorrentino ..... F24F 13/32 454/204
4,691,477 A * 9/1987 Governale ..... E06L 37/00 206/325
5,609,002 A 3/1997 Fernandez
5,967,478 A * 10/1999 Tynes ..... A47B 45/00 248/208
6,460,820 B1 * 10/2002 Kopp ..... F16M 7/00 248/500
7,207,141 B2 4/2007 Sullivan
7,350,759 B1 * 4/2008 Gray ..... F24F 1/027 248/644
8,443,550 B1 5/2013 Burns
8,584,998 B1 * 11/2013 Peterson ..... F24F 13/32 182/62
8,998,690 B1 * 4/2015 Virag ..... F24F 13/32 248/208

(Continued)

*Primary Examiner* — Christopher Garft
(74) *Attorney, Agent, or Firm* — Shifrin Patent Law; Dan Shifrin

(57) ABSTRACT

An AC window security device is provided, comprising: a sill plate bracket, a cross-bar, a pair of U-brackets, and a pair of J-brackets. The sill plate bracket is configured to be secured to a window sill under a window AC unit in an at least partially open window. The lower end of each U-bracket hooks into an opening in one end of the sill plate bracket and extend vertically along a side of the AC unit. The upper end of each J-bracket fits over an upper frame of the at least partially open window. The upper end of each U-bracket is removably secured to the lower end of a corresponding J-bracket. The cross-bar is configured to be positioned along a top surface of the AC unit and removably secured to both U-brackets, wherein the at least partially open window is prevented from being opened.

5 Claims, 8 Drawing Sheets

(56) References Cited

U.S. PATENT DOCUMENTS

| | | | | |
|---|---|---|---|---|
| 9,303,895 | B1 * | 4/2016 | Grant | F24F 13/32 |
| 2010/0270448 | A1 * | 10/2010 | Boccia | F24F 1/027<br>248/208 |
| 2013/0153744 | A1 * | 6/2013 | Jin | F24F 13/32<br>248/670 |
| 2015/0097096 | A1 * | 4/2015 | Arbucci | E06B 7/28<br>248/208 |
| 2016/0109150 | A1 * | 4/2016 | De Jesus | E06B 7/28<br>49/55 |

* cited by examiner

AC WINDOW SECURITY DEVICE

RELATED APPLICATION DATA

The present application is related to commonly-assigned and co-pending U.S. application Ser. No. 62/174,947, entitled AC WINDOW SECURITY DEVICE, filed on Jul. 2, 2015, which application is incorporated herein by reference in its entirety.

TECHNICAL FIELD

The present invention pertains to window air conditioners and, in particular, to a security device to prevent a window in which an air conditioner has been installed from being opened.

BACKGROUND ART

Window air conditioning (AC) units are a relatively inexpensive and convenient way to cool selected rooms or areas. A window is partially opened, the AC unit is installed in the window, and the window is then closed on top of the AC unit. While convenient, window AC units also have some drawbacks, including limited ability to keep the window from being opened, either from someone the outside, such as an intruder trying to break in, or from someone on the inside, such as a child who could fall out.

SUMMARY OF THE INVENTION

Embodiments of the present invention provide an AC window security device, comprising: a sill plate bracket, a cross-bar, a pair of U-brackets, and a pair of U-brackets. The sill plate bracket comprises an elongated flat plate and a bracket on both ends of the flat plate extending substantially perpendicular to the flat plate, each bracket having an opening formed therethrough. The sill plate bracket is configured to be secured to a window sill under a window AC unit in an at least partially open window, the elongated flat plate extending beyond both sides of the AC unit. Each U-bracket comprises a first elongated strip and a narrow hook at a first end. The narrow hook is configured to fit into the opening in one end of the sill plate bracket with the first elongated strip positioned substantially vertically on a side of the AC unit. The J-bracket, comprises a second elongated strip and a wide hook at a first end, configured to fit over an upper frame of the at least partially open window with the second elongated strip positioned substantially vertically on a side of the AC unit. A second end of the U-bracket is removably secured to a second end of the J-bracket. The cross-bar is configured to be positioned along a top surface of the AC unit and removably secured to both U-brackets, wherein the at least partially open window is prevented from being opened.

Embodiments of the present invention also provide a method for securing a window in which an air conditioner (AC) is installed, comprising: securing a sill plate bracket to a window sill under a window AC unit in an at least partially open window, the sill plate bracket extending beyond both sides of the AC unit and having a bracket on both ends extending substantially perpendicular to the window sill, each bracket having an opening formed therethrough; clipping first hooks at lower ends of each of a pair of U-brackets to the openings in the sill plate brackets with a first elongated strip of each U-bracket positioned substantially vertically along the sides of the AC unit; positioning second hooks at upper ends of each of a pair of J-brackets over an upper frame of the at least partially open window with a second elongated strip of each J-bracket positioned substantially vertically on the sides of the AC unit; positioning a cross-bar along a top surface of the AC unit; and securing the first elongated strip of each U-bracket to the second elongated strip of a corresponding J-bracket and securing the cross-bar to both U-brackets, wherein the at least partially open window is prevented from being opened.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
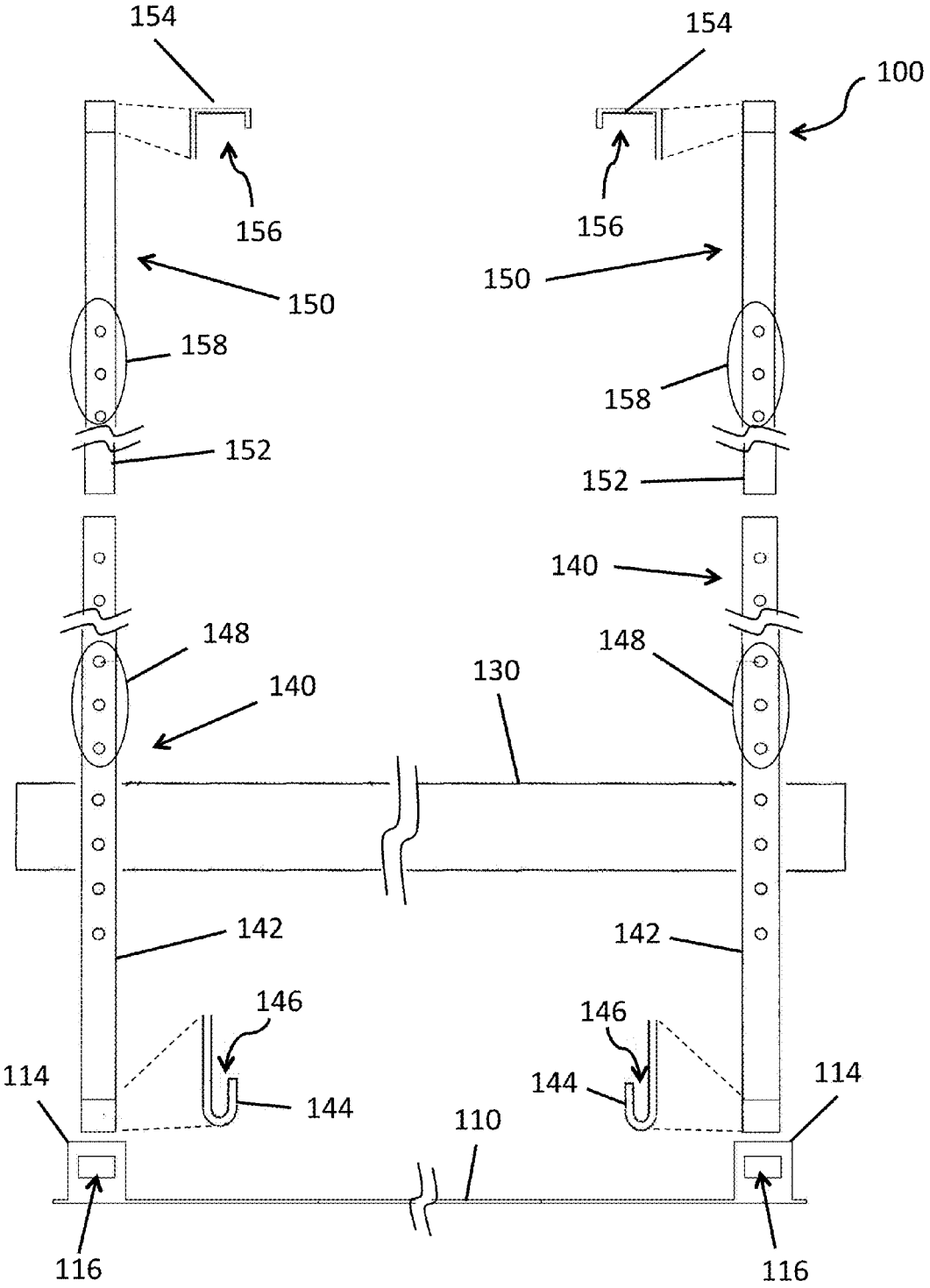
FIG. 1 illustrates an embodiment of an AC window security device of the present invention.

FIG. 1 illustrates an embodiment of an air conditioner (AC) window security device 100 of the present invention. The device 100 includes a sill plate bracket 110, a cross-bar 130, a pair of U-brackets 140, and a pair of J-brackets 150.

Figure 2A:
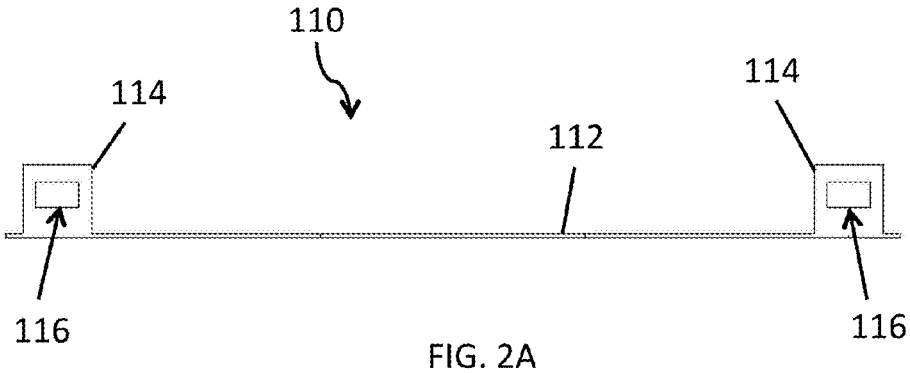
FIG. 2A illustrates a front view an embodiment of a sill plate bracket usable with the security device of FIG. 1.
Figure 2B:
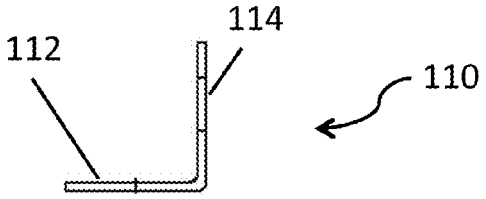
FIG. 2B illustrates an end view of the sill plate bracket of FIG. 2A.
Figure 2C:
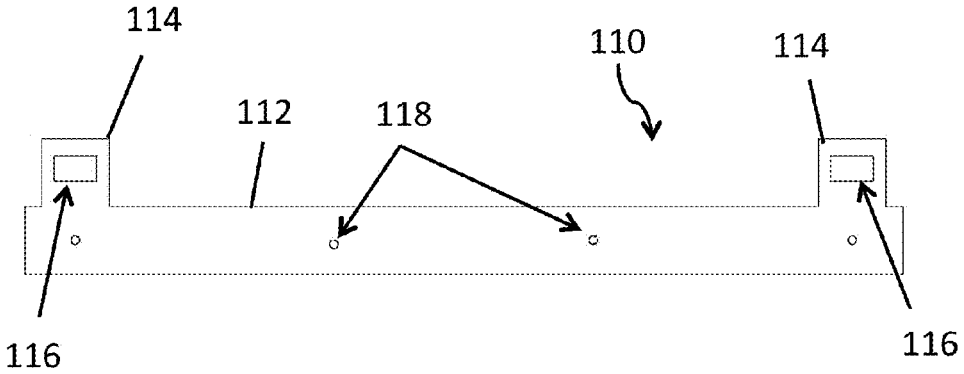
FIG. 2C illustrates a top view of the sill plate bracket of FIG. 2A before the end brackets are bent down.
Figure 3A:
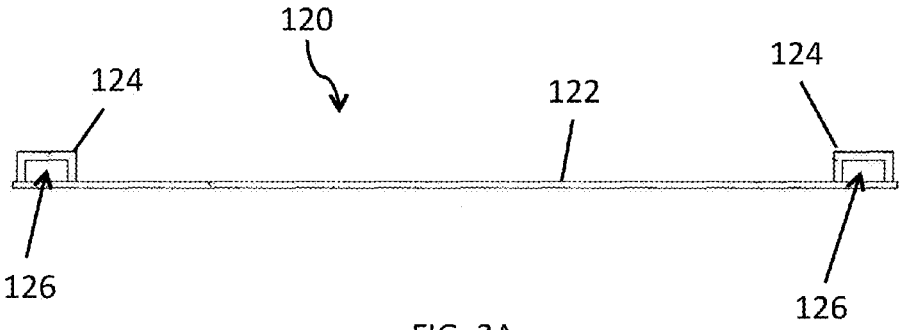
FIG. 3A illustrates a front view another embodiment of a sill plate bracket usable with the security device of FIG. 1.
Figure 3B:
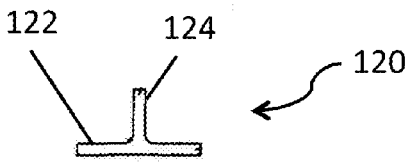
FIG. 3B illustrates an end view of the sill plate bracket of FIG. 3A.
Figure 3C:
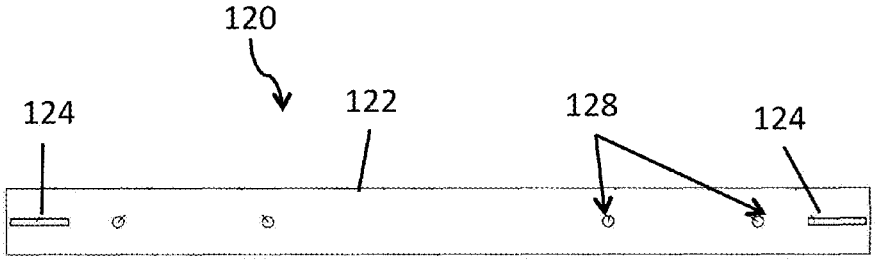
FIG. 3C illustrates a top view of the sill plate bracket of FIG. 3A.

As illustrated in FIGS. 2A, 2B, the sill plate bracket 110 includes an elongated flat plate 112 with a bracket 114 at each end. Both brackets 114 are perpendicular to the flat plate 112 and have an opening 116 formed therethrough. Thus, when the sill plate bracket 110 is installed on a window sill, the flat plate 112 is substantially horizontal and the brackets 114 are substantially vertical. The sill plate bracket 110 also has mounting holes 118 formed through the flat plate 112. In the embodiment illustrated in FIGS. 2A, 2B, the sill plate bracket 110 is cut from a single piece of material and the end brackets 114 are bent about 90° from the flat plate 112 (FIG. 2C). FIGS. 3A-3C illustrate another embodiment of a sill plate bracket 120 having a flat plate 122 with end brackets 124. Both brackets 124 are formed with a T-shaped cross-section and have an opening 126 formed therethrough. The flat plate 122 and the end brackets 124 are cut separately from a material and the brackets 124 welded onto the top surface of the flat plate 122. The sill plate bracket 120 also has mounting holes 128 formed through the flat plate 122.

Figure 4A:
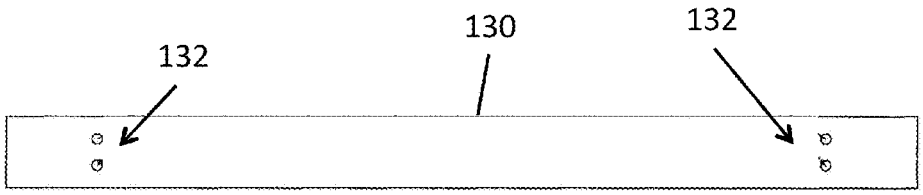
FIG. 4A illustrates a top view of an embodiment of a cross-bar usable with the security device of FIG. 1.
Figure 4B:
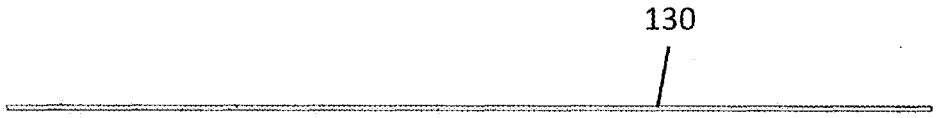
FIG. 4B illustrates a side view of the cross-bar of FIG. 4A.

FIG. 4A and 4B illustrate top and side views, respectively, of an embodiment of a cross-bar 130 usable with the security device 100 of FIG. 1. The cross-bar 130 comprises an elongated flat plate with mounting holes 132 formed through both ends.

Figure 5A:
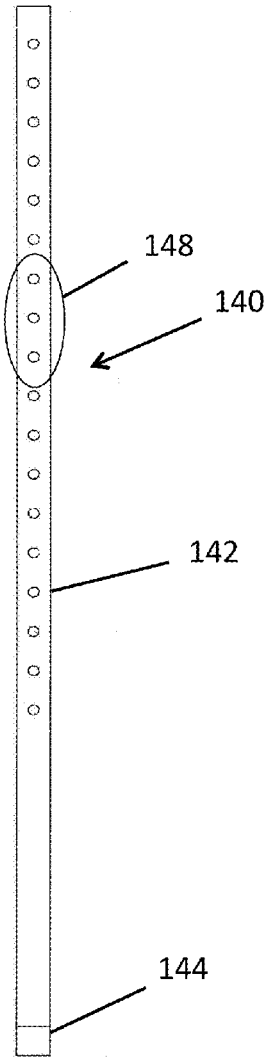
FIG. 5A illustrates a front view of an embodiment of a U-bracket usable with the security device of FIG. 1.
Figure 5B:
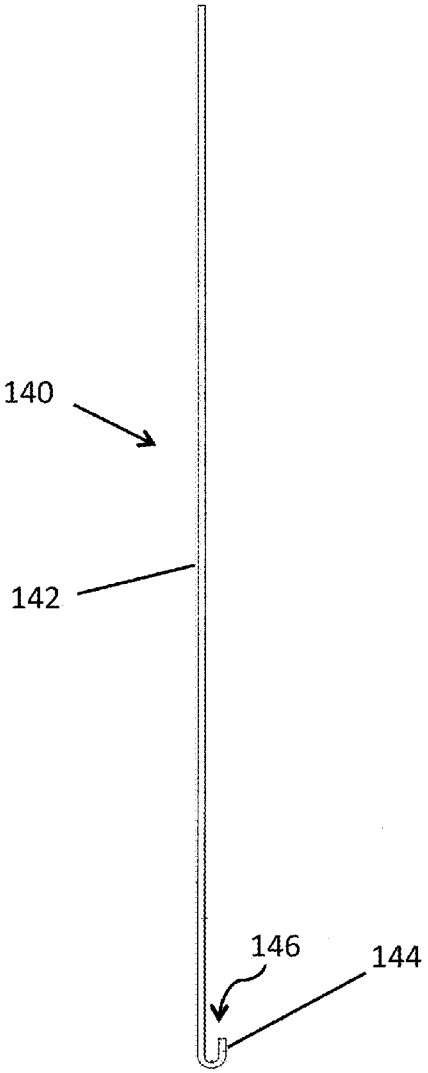
FIG. 5B illustrates a side view of the U-bracket of FIG. 5A.

FIGS. 5A, 5B illustrate front and side views, respectively, of an embodiment of a U-bracket 140 usable with the security device 100 of FIG. 1. Both U-brackets 140 comprise an elongated strip 142 with a narrow hook 144 at the bottom end, forming an upward-opening channel 146 (best seen in FIG. 5B). Spaced-apart mounting holes 148 are formed along the elongated strip 142.

Figure 6A:
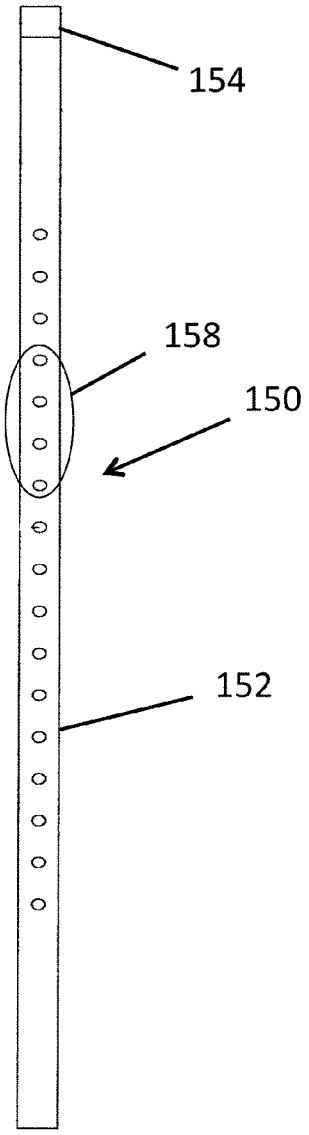
FIG. 6A illustrates a front view of an embodiment of a J-bracket usable with the security device of FIG. 1.
Figure 6B:
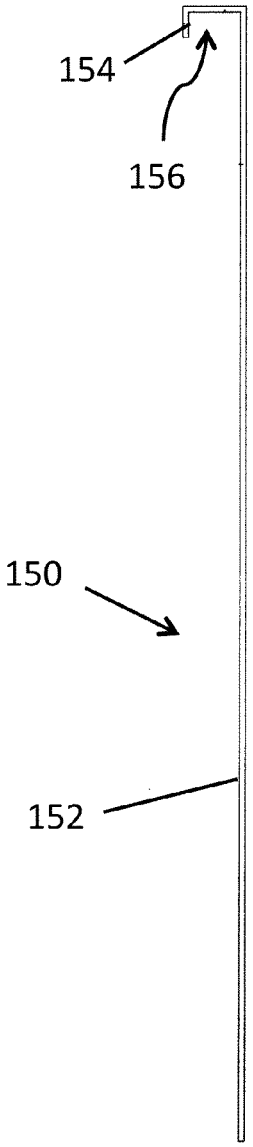
FIG. 6B illustrates a side view of the J-bracket of FIG. 6A.

FIGS. 6A, 6B illustrate front and side views, respectively, of an embodiment of a J-bracket 150 usable with the security device 100 of FIG. 1. Both J-brackets 150 comprise an elongated strip 152 with a wide top hook 154 at the top end, forming an downward-opening channel 156 (best seen in FIG. 6B). Spaced-apart mounting holes 158 are formed along the elongated strip 152.

Figure 7:
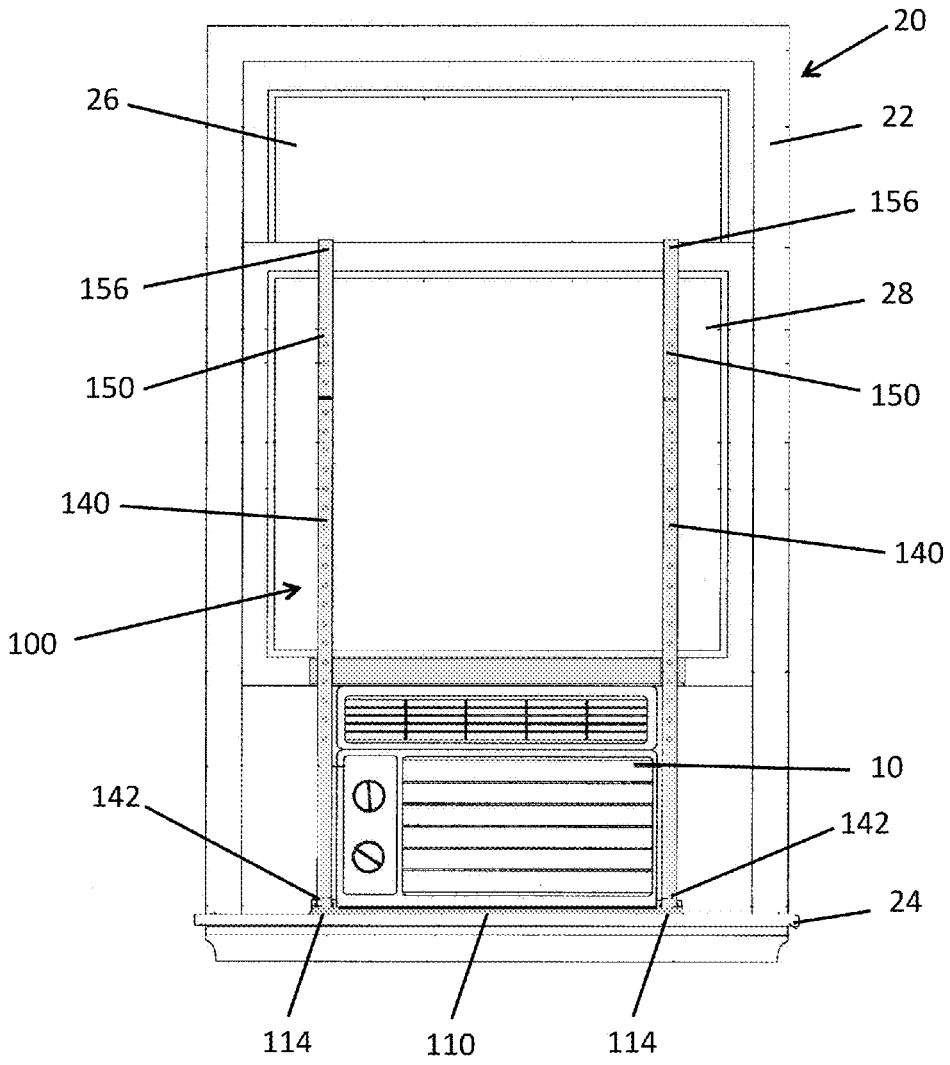
FIG. 7 illustrates the security device of FIG. 1 installed on a window.

FIG. 7 illustrates the AC window security device 100 installed around an AC unit 10 in a window 20. The window 20 includes a frame 22, a sill 24, an upper window 26 and a lower window 28. Although FIG. 7 illustrates the security device 100 installed in a double-hung window, it may also be installed in a single-hung window. To install the security device 100, the sill plate bracket 110 is secured to the top of the window sill 24, such as by screwing the flat plate 112 into the sill 24 through the holes 118. The lower window 28 is raised and the AC unit 10 is then mounted in the window 20 with the bottom of the AC unit 10 resting on top of the flat plate 112 of the sill plate bracket 110. The lower window 28 is lowered onto the top of the AC unit 10. The top hooks 154 of the J-brackets 150 are positioned so that the top of the lower window 28 fits within the channels 156. With the U-brackets 140 on either side of the AC unit 10, the narrow hooks 144 of the U-brackets 140 are inserted into the openings 116 of the brackets 114 of the sill plate bracket 110. The elongated strips 142, 152 of the J-brackets 140 and U-brackets 150 are bolted together through the holes 148, 158. The cross-bar 130 is then positioned across the top of the AC unit 10 and bolted to the elongated strips 152 of the two U-brackets 150 through the holes 132, 148. For additional security, the U-brackets 140 and the cross-bar 130 may also be screwed into the lower frame of the lower window 28, again through the holes 132, 148.

The security device 100 is easily removed by reversing the installation steps, such as for maintenance or during the colder season when the AC unit 10 is removed and stored. The sill plate bracket 110 may be left in place if desired.

The sill plate bracket 110, cross-bar 130, U-brackets 140, and J-brackets 150 may be formed from any appropriate material, such as aluminum, steel, or other metal, and may be untreated, galvanized, or powdered coated. Although screws, nuts, and bolts are one method of securing the components together and to the window 20, other fasteners may also be used. Any of the components may have a foam backing to protect the surface of the window sill or frame.

The dimensions of the components are not critical to the practice of the present invention. Moreover, the components of the security device 100 may be manufactured in a variety of sizes to accommodate windows and AC units of different sizes. Thus, the following dimensions are provided as examples only and are not meant to be limiting. For a standard size double-hung window illustrated in the figures, the sill plate bracket 110 may be 26 inches long and two inches wide, and the brackets 114 may be two inches high. The U-brackets 140 may be about 30 inches long or shorter for a small window to about 96 inches or longer for a large window and 1 inch wide. The cross-bar 130 may be about 26 inches long (or longer or shorter) and two inches wide. The J-brackets 150 may be about 33 inches long (or longer or shorter) and 1 inch wide. The cross-bar 10, U-brackets 140, and J-brackets may be ⅛ to 3⁄16 inches thick. Again, the components may be manufactured to various dimensions to fit windows of various dimensions.

Figure 8:
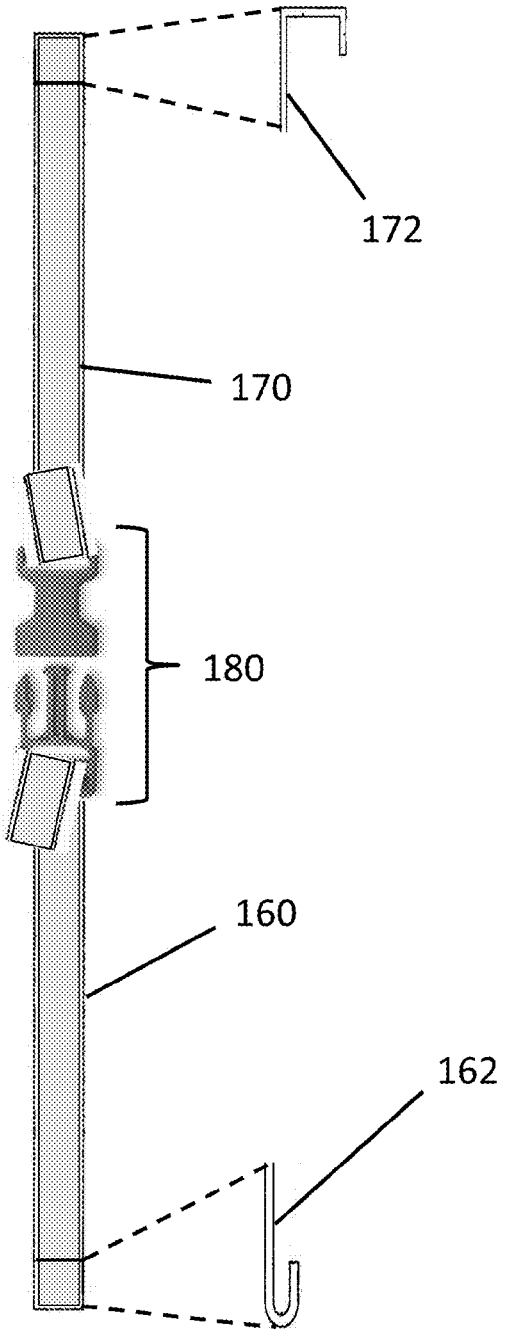
FIG. 8 illustrates another embodiment of a U-bracket and a J-bracket usable with the AC window security device of the present invention.

In another embodiment of the security device 100, illustrated in FIG. 8, upper and lower straps 160, 170, made from a fabric such as nylon, Kevlar, or other like material, may be substituted for the U-brackets 140 and J-brackets 150. A U-hook 162 secured to the lower end of the lower strap may be hooked into the opening 116 in the bracket 114 and a J-hook 172 secured to the upper end of the upper strap 170 may hook over the top of the lower window 28. A releasable connector 180, such as a side-release adjustable buckle or other like connector, may be used to connect and tighten the two straps 160, 170 when installing the security device 100.

With the AC window security device 100 installed in the window 20 around the AC unit 10, the lower window 28 cannot be raised, thereby preventing anyone on the outside gaining entrance through the window 20 and preventing anyone on the inside, such as a child, from accidentally falling out of the window 20.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An air conditioner (AC) window security device, comprising:

a sill plate bracket, comprising:

an elongated flat plate; and a bracket on both ends of the flat plate extending perpendicular to the flat plate, each bracket having an opening formed therethrough;

the sill plate bracket configured to be secured to a window sill under a window AC unit in an at least partially open window, the elongated flat plate extending beyond both sides of the AC unit;

a pair of U-brackets, each comprising:

a first elongated strip; and a narrow hook at a first end;

the narrow hook configured to fit into the opening in one end of the sill plate bracket with the first elongated strip positioned vertically along a side of the AC unit;

pair of J-brackets, each comprising:

a second elongated strip; and a wide hook at a first end, configured to fit over an upper frame of the at least partially open window with the second elongated strip positioned vertically on a side of the AC unit, a second end of the first elongated strip being removably secured to a second end of the second elongated strip; and a cross-bar configured to be positioned along a top surface of the AC unit and removably secured to both U-brackets, wherein cross-bar is configured to prevent the at least partially open window from being opened.

2. The AC window security device of claim 1, wherein the first elongated strip of each U-bracket and the second elongated strip of each J-bracket are formed from metal.

3. The AC window security device of claim 1, wherein:

the first elongated strip of each U-bracket comprises a fabric strap;

the second elongated strip of each J-bracket comprises a fabric strap; and the AC window security device further comprises a connector to releasably connect the second end of the first elongated strip with the second end of the second elongated strip.

4. The AC window security device of claim 1, wherein the brackets of the sill plate bracket comprise a T-shaped bracket welded onto the flat plate.

5. The AC window security device of claim 1, wherein the flat plate and the brackets of the sill plate comprise a single piece of material, the brackets being perpendicular to the flat plate.

* * * * *